United States Patent [19]

Yarbrough

[11] 4,186,965

[45] Feb. 5, 1980

[54] FIBERBOARD CHAIR CONSTRUCTION

[76] Inventor: Jon A. Yarbrough, 5714 Vanderbilt, Dallas, Tex. 75206

[21] Appl. No.: 883,918

[22] Filed: Mar. 6, 1978

[51] Int. Cl.[2] ..... A47C 7/00

[52] U.S. Cl. ..... 297/442

[58] Field of Search ..... 297/440, 442

[56] References Cited

U.S. PATENT DOCUMENTS

| | | | |
|---|---|---|---|
| 2,806,514 | 9/1957 | Smith | 297/442 |
| 2,904,105 | 9/1959 | Holden | 297/442 |
| 2,940,513 | 6/1960 | Holden | 297/442 |
| 2,955,647 | 10/1960 | Smith | 297/442 X |
| 3,331,634 | 7/1967 | Harrison | 297/442 |
| 3,640,575 | 2/1972 | Dosi | 297/440 |
| 3,695,703 | 10/1972 | Notko | 297/442 |

*Primary Examiner*—James C. Mitchell

*Attorney, Agent, or Firm*—Arnold, White & Durkee

[57] ABSTRACT

A chair constructed of lightweight material such as fiberboard utilizes a one-piece, rectangular panel of foldable material to cover a seat support structure of perpendicularly disposed, interlocking support panels. The seat support structure defines a seat area that is covered by a portion of the cover panel defined by two parallel cuts therein that extend longitudinally of the panel for a predetermined distance and are spaced from each end of the cover panel. The cover panel is held in position around the seat support structure by tabs provided at each end for insertion into a transverse notch formed in the underside of the seat support structure.

7 Claims, 11 Drawing Figures

FIBERBOARD CHAIR CONSTRUCTION

BACKGROUND OF THE INVENTION

The present invention relates to furniture construction; and more particularly, it relates to a structural system for furniture constructed of lightweight materials, such as corrugated fiberboard or the like.

Furniture articles, such as chairs, made of fiberboard or the like are well-known in the art and are recognized as being relatively inexpensive and of light weight. Since materials like fiberboard are of limited strength and durability, the application of such materials to the making of chairs or similar articles of furniture requires that construction techniques be utilized that provide articles capable of withstanding and supporting the weight of users of the chair.

A common feature of most construction techniques used in fiberboard chairs is that of interlocking slotted structural components disposed perpendicular to one another. Such construction is typically used in the seat portion of the furniture article where the greatest amount of support and strength is required. Representative of this type of construction are Smith, U.S. Pat. No. 2,806,514; Holden, U.S. Pat. No. 2,904,105; Holden U.S. Pat. No. 2,940,513; Smith, U.S. Pat. No. 2,955,647; Harrison, U.S. Pat. No. 3,331,634; and Notko, U.S. Pat. No. 3,695,703.

Although the above patents employ the aforementioned basic feature of fiberboard furniture construction, the actual manner of implementation of this construction feature and other features of fiberboard chair construction, such as the manner of covering the outside portion of the chair, have been widely divergent.

One technique for covering the outside portion of the seat support structure is that of using several separate fiberboard panels having hinged tabs and slots to engage one another. Representative of fiberboard chairs using this type of construction techniques are the Holden patents.

For example, the U.S. Pat. No. 2,904,105, Holden patent discloses a fiberboard chair wherein the seat bottom and back portions are covered by a single panel folded to conform to the shape of the chair, and each arm and side section is covered by a separate outer panel. In the U.S. Pat. No. 2,940,513, Holden patent, L-shaped panels for covering the sides of the chair are hinged to a panel that partially covers the backside of the seat back. A front section panel includes a rectangular seat bottom panel, and a separate panel is used to cover the front side and the remainder of the backside portions of the seat back.

Another approach to covering the support structure of a fiberboard chair is that of using a fiberboard blank cut and scored for folding into a housing for the seat support structure. Representative of this type of construction technique are Smith, U.S. Pat. No. 2,806,514; Smith, U.S. Pat. No. 2,955,647; Harrison, U.S. Pat. No. 3,331,634; and Notko, U.S. Pat. No. 3,695,703.

The U.S. Pat. No. 2,955,647, Smith patent, for example, covers a core structure of interlocking components with an upright, rectangular tube that is scored for folding to create panel sections for covering the seat, back and arm portions that are defined by the core structure.

The chair construction described in the U.S. Pat. No. 2,806,514 Smith patent utilizes a single blank of fiberboard that is cut to provide a back panel, side panels, and attached to one of the panels is an end panel. The blank is scored for folding to place the side panels at right angles to the back panel, with the end panel being positioned at right angles to the side panels. Support panels are arranged within the housng structure defined by the folded blank and are interlocked with parts of the housing in order to provide strength to it. The forward portions of the side panels are scored to provide flaps provided with tabs. Upon folding, the forward portions of the side panels provide a cover for the seat back.

SUMMARY OF THE INVENTION

In accordance with the present invention, a furniture item is provided that may be suitably made from lightweight materials such as fiberboard or the like. A furniture item embodying the present invention comprises a support structure of perpendicularly disposed, interlocking panels defining a seat area therebetween, and a rectangular panel of foldable material having two parallel cuts therein that extend longitudinally of the panel for a predetermined distance, and that are spaced a predetermined distance from each end of the panel. The panel is wrapped around the seat support structure to cover the same, with the portion of the cover panel between the cuts being utilized to overlay the seat area.

Further in accordance with the present invention, the seat support structure utilized in the furniture item is one that comprises a plurality of vertical panels arranged side-by-side. The panels are configured to define a seat bottom portion and a seat back portion, with each panel having a plurality of spaced apart slots formed therein. A plurality of cross-bridging panels extending transverse to the vertical panels are interlocked therewith by insertion of each bridging panel into corresponding slots in each of the vertical panels.

In accordance with one particular embodiment of the present invention, the vertical panels of the support structure are crescent shaped, with the slots formed therein being equally distributed along the radius of one side of the panel. In another particular embodiment of the present invention, the vertical panels of the seat support structure are substantially L-shaped and have slats formed therein extending from one side of the panel.

In another aspect of the present invention, the cover panel that is wrapped around the periphery of the seat support structure has a tab section formed at each end to be inserted in a notch formed along the underside of the support structure to hold the cover panel in place.

In accordance with a preferred embodiment of the present invention, end panel sections are provided at each end of the seat support structure. Each end panel section comprises an inside panel section and an outside panel section with one or more spacers inserted between the inside and outside panel sections.

Further, the seat support bridging panels are of equal length, but of different widths, and have slots formed therein extending transverse to a longitudinal side of the panel, such that, upon being interlocked with a vertical panel by insertion into a slot therein, a portion of a vertical panel will be held within the slot in the cross-bridging panel, and a portion of the cross-bridging panel will be held in the slot in the vertical panel.

DESCRIPTION OF THE DRAWINGS

A more complete understanding of the invention may be had by referring to the Detailed Description which follows, when taken in conjunction with the accompanying Drawings, wherein.

DETAILED DESCRIPTION

Figure 1:
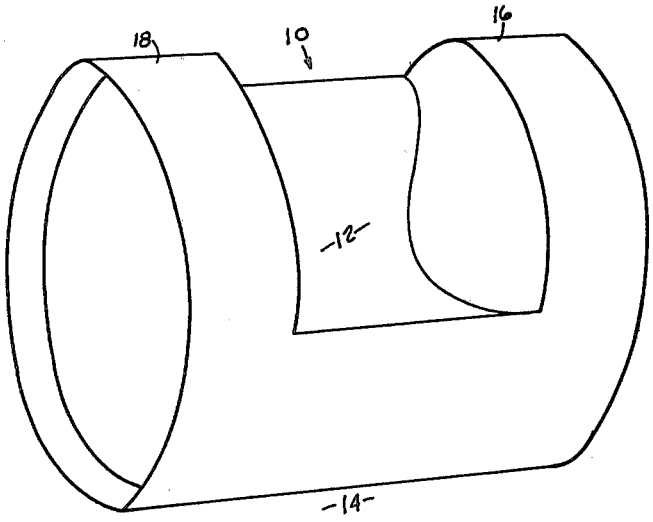
FIG. 1 is a perspective view of one embodiment of the present invention in the form of a chair.

Referring now to the drawings, and particularly to FIG. 1 thereof, there is shown a furniture item 10 in accordance with the present invention. Furniture item 10 is of a cylindrical configuration with a seat area 12 formed therein to provide a chair. Chair 10 is adapted for placement on a surface 14 such as the floor of a dwelling unit. In addition to the seat area 12, chair 10 further includes arm rests 16 and 18 positioned on each side of the seat area.

Figure 2:
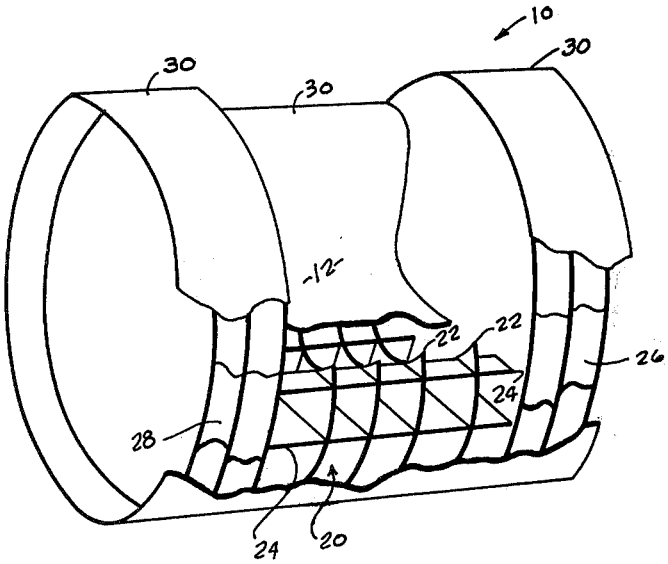
FIG. 2 is a sectioned view of the chair shown in FIG. 1.

Referring now to FIG. 2, the cutaway view presented therein provides a detailed illustration of the constructional system of the present invention as embodied in chair 10. As shown, chair 10 incorporates a seat support structure 20 comprising a plurality of vertical seat support panels 22 configured to define the seat area 12. Seat support structure 20 further comprises a plurality of seat support briding panels 24 extending transverse to vertical seat support panels 22 and interlocking therewith to provide spacing and reinforcement to the vertical panels.

Chair 10 also includes end panels generally designated by the numerals 26 and 28 which are disposed on each side of seat support structure 20. A cover panel 30 overlays the seating area 12 defined by seat support structure 20 and also overlaps end panels 26 and 28.

Figure 3:
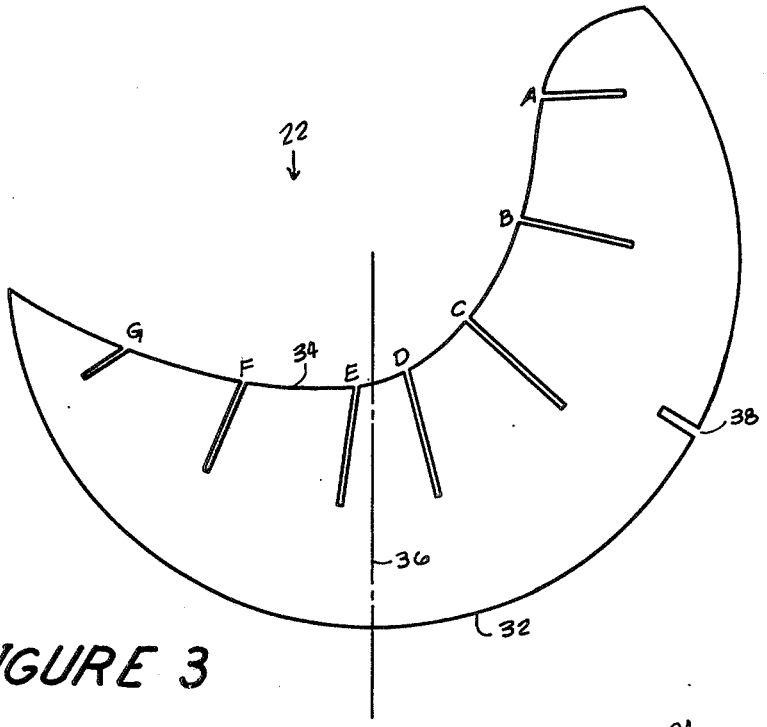
FIG. 3 is a side view of a representative one of the vertical panels of the seat support structure utilized in the chair of FIG. 1.
Figure 4:
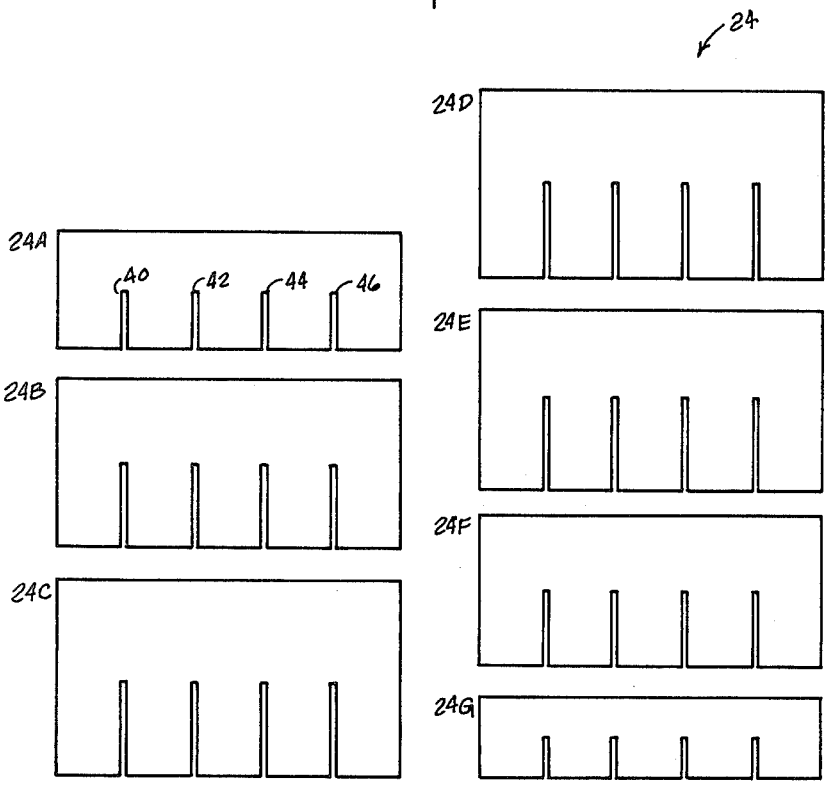
FIG. 4 is a top view of the seat support bridging panels utilized in conjunction with the seat support panels to form the seat support structure utilized in the chair shown in FIG. 1.

Turning now to FIGS. 3 and 4, there is shown in detail a representative one of the vertical support panels 22 and the seat support bridging panels 24 which in combination comprise seat support structure 20 for the embodiment shown in FIGS. 1 and 2.

As shown, vertical support panel 22 for the embodiment shown in FIG. 1 is of a crescent shape having a circular bottom edge portion 32 and an irregular, concave upper edge portion 34. Along the radius of the upper concave edge portion 34, a series of slots designated A through G are formed therein. Slots A–G are of varying lengths and extend at varying positional attitudes with respect to upper edge portion 34. The curvature of the upper edge portion 34 of support panel 22 is configured to provide for comfortable sitting and adequate support of the human body when disposed in a sitting position.

Since the center of gravity of a person sitting in a chair configured in accordance with the shape of upper edge portion 34 will focus the load imposed upon each vertical support panel substantially along a line of action 36, the spacing between slots D and E is reduced to provide more support strength through that area of the support panels. Each support panel 22 further includes a notch 38 formed in the bottom edge portion 32. The utility of notch 38 will be more fully explained hereinafter with regard to a disucssion of the assembly of chair 10 from the various structural components.

Referring now to FIG. 4, the cross-bridging panels 24 for insertion into slots A–G in each of the vertical support panels 22 are shown. Cross-bridging panels are designated 24A–24G, with the letter designation identifying the particular one of the slots in each vertical panel into which the panel is to be inserted. As will be apparent from FIG. 4, the cross-bridging panels 24 used in interconnecting the vertical support panels to form the seat support structure are of equal length, but vary in width. Each of support panels 24 includes four equally spaced slots formed intermediate the ends of each panel. For example, panel 24A has slots 40, 42, 44 and 46. Each of the slots extends a predetermined distance from one side of the panel. Accordingly, upon being interlocked with the A slots in vertical panels 22, a portion of each bridging panel is held therein. Similarly, upon interlocking, a portion of the vertical panel is held within each of the slots 40, 42, 44 and 46 in the bridging panel 24A. By such an arrangement, the cross-bridging panels and the vertical panels are securely interlocked and each cross-briding panel spans the entire distance between the bottom side edge portion 32 and the top side portion 34 along a line defined by slots A–G in the vertical panels.

Figure 5:
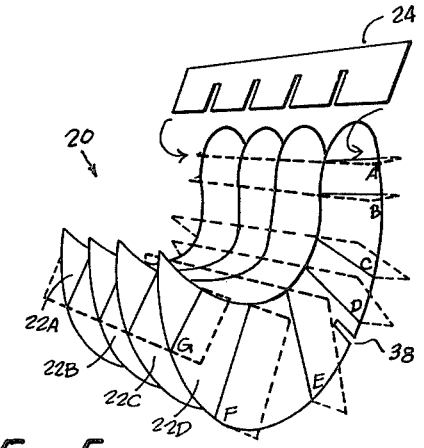
FIGS. 5–7 are perspective views illustrating the manner in which the chair shown in FIG. 1 is assembled.
Figure 6:
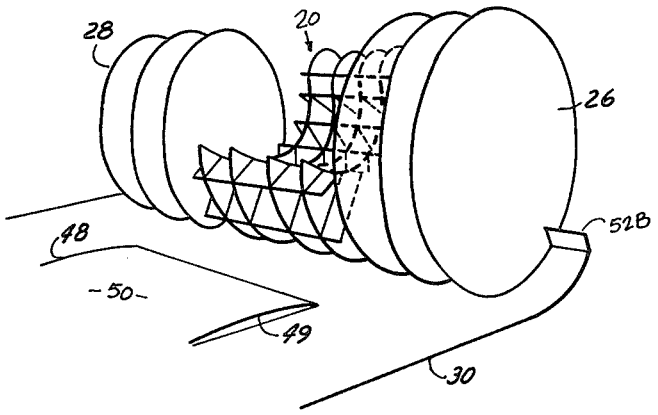
Figure 7:
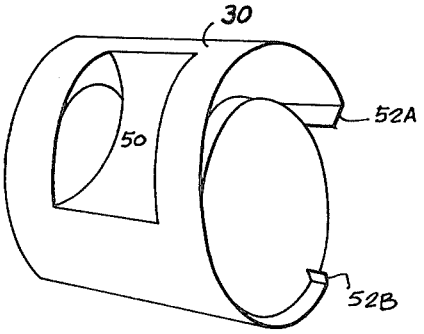

Referring now to FIGS. 5–7, the manner in which the various structural components that comprise chair 10 of FIG. 1 are assembled will be described.

Referring first to FIG. 5, the support structure 20 is assembled by the interlocking of vertical panels 22A, 22B, 22C and 22D with cross-bridging panels 24A–24G. As shown in FIG. 5, each of the cross-bridging panels 24 is inserted into a corresponding one of the slots in each of the vertical panels. Cross-bridging panels 24 place the vertical panels 22 in a parallel arrangement with equal spacing between each one.

Referring now to FIG. 6, after the support structure 20 has been assembled in the aforementioned manner, it is positioned on rectangular panel 30 of foldable material having two parallel cuts 48 and 49 therein that extend longitudinally along panel 30 for a predetermined distance and are spaced a predetermined distance from each of the panel. The end panel sections 26 and 28 may be positioned on each side of support structure 20, and the cover panel 30 wrapped around the periphery of the seat support structure and the end panel sections. Alternatively, the cover panel can be wrapped around the periphery of the seat support structure and the end panels subsequently inserted into the circular opening formed at each side of the support structure by the cover panel. The portion 50 of the panel 30 between cuts 48 and 49 forms a seat cover for overlaying the seat area. FIG. 7 illustrates the wrapping of panel 30 around the support structure and the end panels with the portion 50 of the panel being pushed down and into the recessed seat area between the end panels. Note that at each end of panel 30 a tab 52A and 52B are formed. Tabs 52A and 52B are inserted into notch 38 to hold cover panel 30 securely in its wrapped position.

Figure 8:
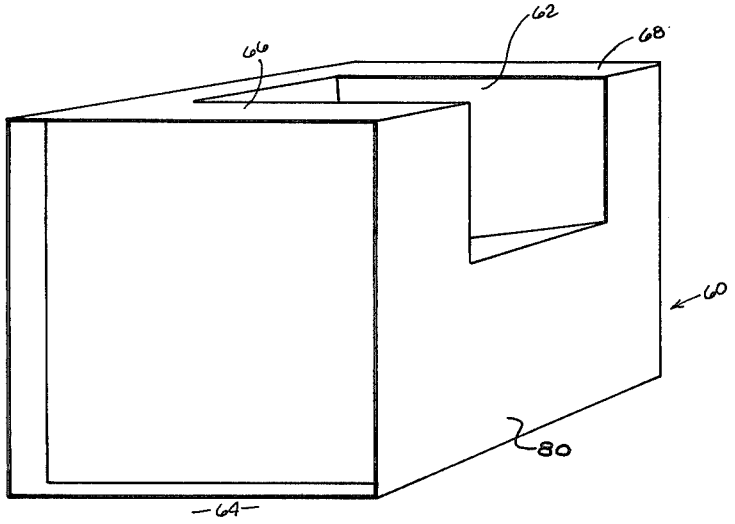
FIG. 8 is a perspective view of a second embodiment of the present invention.

Referring now to FIGS. 8–11, an alternate embodiment of the present invention is shown in which a chair 60 is constructed utilizing the same constructional system as utilized in chair 10. Chair 60 shown in FIG. 8 is generally configured as a cube with a seat area 62 being formed therein. Chair 60 is adapted for placement on a surface 64. In addition to the seat area 62, chair 60 further includes armrests 66 and 68 positioned on each side of the seat area.

Figure 9:
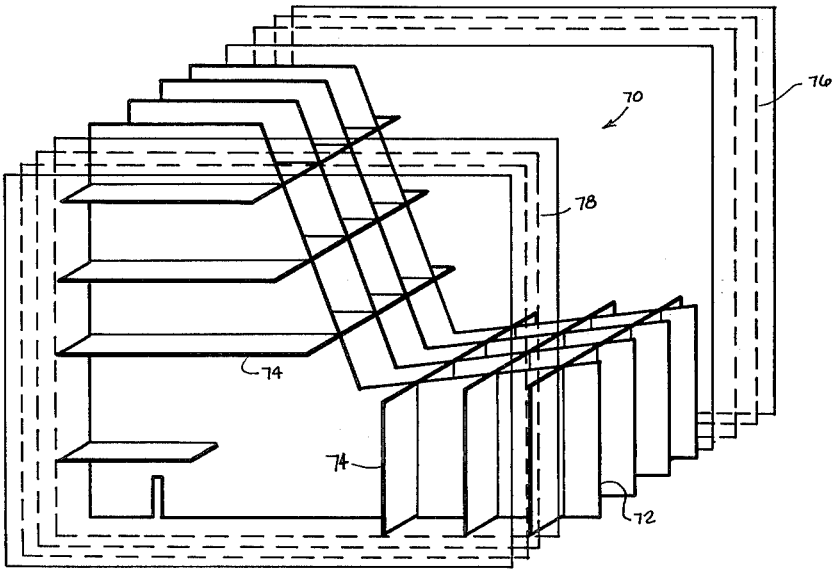
FIG. 9 is a perspective cutaway view of the chair shown in FIG. 8.

Referring now to FIG. 9, the cutaway view presented therein provides a detailed illustration of the constructional system of the present invention as embodied in char 60. As shown, chair 60 incorporates a seat support structure 70 comprising a plurality of vertical seat support panels 72 configured to define the seat area 62. Seat support structure 70 further comprises a plurality of seat support bridging panels 74 that extend transverse to the vertical seat support panels 72 and interlock therewith to provide spacing and reinforcement to the vertical panels.

Chair 60 also includes end panel sectional generally designated by the numerals 76 and 78, which are disposed on each side of seat support structure 70. The cover panel 80 shown in FIG. 8 overlays the seating area 62 defined by seat support structure 70 and also overlaps end panels 76 and 78.

Figure 10:
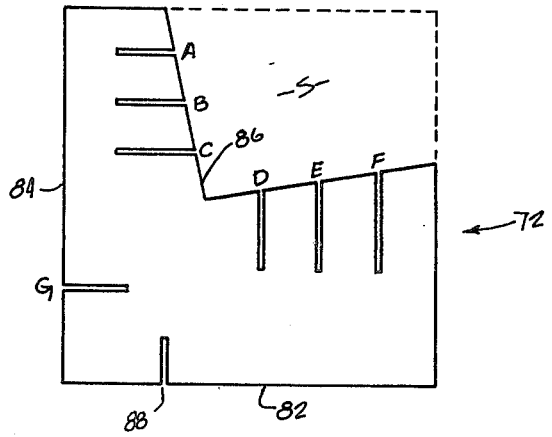
FIG. 10 is a side view of the vertical seat support panels utilized in the seat support structure of the chair shown in FIG. 8.
Figure 11:
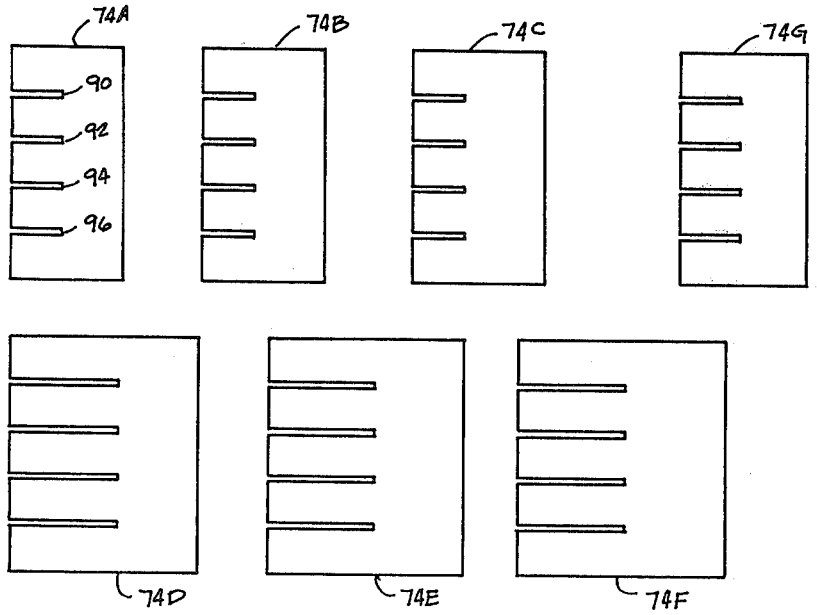
FIG. 11 is a top view of the seat support bridging panels utilized in the seat support structure of the chair shown in FIG. 8.

Turning now to FIGS. 10 and 11, there is shown in detail a representative of one of the vertical support panels 72 and the seat support bridging panels 74, which in combination comprise seat support structure for the embodiment shown in FIGS. 8 and 9.

As shown, vertical support panel 72 shown in FIG. 10 is of a generally L-shaped configuration having a bottom edge portion 82 that is disposed perpendicular to a back side edge portion 84. Vertical support panel 72 has an upper edge portion 86 configured as a canted L that is formed by the removal of a section S from a square blank panel. The L-shaped upper edge portion 86 is canted to provide a reclining seat back in order to make chair 60 more comfortable to sit in.

Slots A–C, each of a different length, are formed in the seat back portion of upper edge 86. Similarly, slots D–F are formed in the seat bottom portion of upper edge 86 of vertical panels 72. A slot 88 is formed perpendicular to the bottom edge 82. The utility of slot 88 will be more fully explained hereinafter with regard to a discussion of the assembly of chair 60 from the various structural components. A slot G is formed perpendicular to edge 84 for receiving a bridging panel to add strenth and provide separation of panels 72.

Referring now specifically to FIG. 11, the cross-bridging panels 74 for insertion into slots A–G in each of the vertical panels 72 are shown. Cross-bridging panels 74 are designated 74A–74G, with the letter designation identifying the particular slot in each vertical panel into which the cross-bridging panel is to be inserted.

As will be apparent from FIG. 11, the cross-bridging panels 74 used in interconnecting the vertical support panels to form the seat support structure 70 are of equal length, but varying width. Each of the support panels 74 include four equally spaced slots formed therein intermediate the ends. For example, 74A has slots 90, 92, 94 and 96. Each of the slots in the cross-bridging panels extend a predetermined distance from one side of the panel. Accordingly, upon interlocking of panel 74A with the A slot in each vertical panel 72, a portion of cross-bridging panel 74A will be held within the A slot in each vertical panel. Correspondingly, a portion of the vertical panel 72 will be held within slots 90, 92, 94 and 96 in the cross-bridging panel 74A. By such an arrangement, the cross-bridging panels and the vertical panels are securely interlocked and the cross-bridging panels span the entire distance between the upper edge portion 86 and the bottom edge portion 82 and the back side edge portion 84.

Referring once again to FIGS. 8 and 9, the manner in which the various structural components that comprise chair 60 of FIG. 8 are assembled can be readily appreciated. The support structure 70 is assembled by the interlocking of the vertical panels 72 with the cross-bridging panels 74. As shown in FIG. 9, each of the cross-bridging panels 74 is inserted into the corresponding one of the slots in each of the vertical panels; and accordingly, cross-bridging panels 74 place the vertical panels 72 in a parallel arrangement with equal spacing between each one. After the support structure 70 has been assembled in the aforementioned manner, it is positioned on a rectangular panel of foldable material having two parallel cuts therein that extend longitudinally along the panel for a predetermined distance and are spaced a predetermined distance from each end of the panel. The cover panel is wrapped around the periphery of the seat support structure with the portion of the panel between the parallel cuts forming a seat cover for overlying the seat area defined by the upper edge 86 of each vertical support panel. The cover panel is held in position by the insertion of tabs at each end of the panel into slot 88 formed on the bottom edge 82 of each vertical panel.

Although the chairs 10 and 60 are herein described as having armrests at each side of the seat area as is usual in such articles of furniture, the present invention contemplates an arrangement wherein a pair of separate and distinct chairs may be placed together side-to-side in such manner as to provide a sofa-type furniture item. Accordingly, in such arrangements, the armrest on one side of each of the chairs would be removed, providing only one arm. The two chairs so constructed, when placed side-by-side with their armless sides in abutting relationship, provide a sofa that is the width of two chairs.

The foregoing description of the present invention has been directed to two particular preferred embodiments for purposes of explanation and illustration. It will be apparent, however, to those skilled in this art that many modifications and changes may be made without departing from the scope and spirit of the invention. Accordingly, it is the Applicant's intention in the following claims to cover all equivalent modifications and variations as fall within the spirit and scope of the invention. What is claimed is:

1. A furniture item formed of paperboard, comprising:

A support structure of perpendicularly disposed, interlocking panels, a portion of the topside periphery thereof defining seat bottom and seat back portions;

first and second end panels, each being disposed adjacent the support structure on opposite sides thereof, each panel conforming to the shape of the bottom side periphery of the support structure to be coextensive therewith and extending beyond the topside periphery of the seat structure to define armrests on each side of the seat area and to establish a seat area entirely recessed within the periphery of the end panels; and a rectangular panel of foldable material having two parallel cuts therein that extend longitudinally of the panel for a distance equal to the linear length of the topside periphery portion of the seat structure which defines the seat bottom and seat back portions and that are spaced a distance from each side of the panel equal to the width of the first and second end panels, the panel being wrapped around the seat support structure and the end panels with the portion of the panel between the cuts being depressible into the recessed seat area defined by the end panels to overlay the seat bottom and seat back portions of the support structure.

2. The furniture item of claim 1 wherein the seat support structure comprises:

a plurality of vertical panels arranged side-by-side, the panels being configured to define a seat bottom portion and a seat back portion, with each panel having a plurality of spaced apart slots formed therein; and a plurality of cross-bridging panels extending transverse to the vertical panels and being interlocked therewith by insertion of each bridging panel into corresponding slots in each of the vertical panels.

3. The furniture item of claim 2 wherein the vertical panels are crescent shaped.

4. The furniture item of claim 3 wherein the slots in the vertical panel are unequally distributed along the edge of one side of the panel.

5. The furniture item of claim 2 wherein the vertical panels are generally L-shaped.

6. The furniture item of claim 1 wherein the cover panel has a tab section formed at each end and the support structure has a slot formed along an edge thereof, the cover panel being held in place by insertion of the end tabs into the slot in the support structure.

7. The furniture item of claim 2 wherein each cross-bridging panel has a number of slots, corresponding to the number of vertical panels, formed therein extending from one side thereof, such that upon interlocking of a cross-bridging panel with the vertical panesls a portion of the cross-bridging panel is held in a vertical panel slot and a portion of each vertical is held in one of the cross-bridging panel slots.

* * * * *